US005236233A

United States Patent [19]

Fukumoto et al.

[11] Patent Number: 5,236,233

[45] Date of Patent: Aug. 17, 1993

[54] LID LOCK APPARATUS

[75] Inventors: Ryoichi Fukumoto, Nagoya; Kazuhide Itagaki, Kariya; Kazuhiro Sumiya, Hekinan; Yasuaki Suzuki, Kariya; Kouji Ooe, Nagoya, all of Japan

[73] Assignee: Aisin Seiki Kabushiki Kaisha, Kariya, Japan

[21] Appl. No.: 858,157

[22] Filed: Mar. 27, 1992

[30] Foreign Application Priority Data

Mar. 29, 1991 [JP] Japan ..... 3-20035[U]
Mar. 29, 1991 [JP] Japan ..... 3-66634

[51] Int. Cl.[5] ..... E05B 47/00

[52] U.S. Cl. ..... 292/144; 292/171; 74/500.5

[58] Field of Search ..... 292/125, 171, 144, 201, 292/225, DIG. 14, DIG. 25, DIG. 62; 74/500.5

[56] References Cited

U.S. PATENT DOCUMENTS 4,045,064 8/1977 Okada ..... 292/DIG. 14 X
4,544,189 10/1985 Fiordellisi et al. ..... 292/336.3 X
4,840,080 6/1989 Kohayashi et al. ..... 74/500.5 X
5,044,678 9/1991 Detweiler ..... 292/144

FOREIGN PATENT DOCUMENTS

3407125A1 9/1985 Fed. Rep. of Germany .

*Primary Examiner*—Richard E. Moore
*Attorney, Agent, or Firm*—Finnegan, Henderson, Farabow, Garrett and Dunner

[57] ABSTRACT

A lid lock apparatus is comprised of a lid pivotally mounted to a vehicle-body for opening/closing an opening formed therein and movable between an opening position and a closing position, a locking mechanism which is in engagement with the lid in order to hold the lid at its closing position, a first driving mechanism associated with the locking mechanism for releasing the lid from the locking mechanism, a second driving mechanism associated with the locking mechanism for releasing the lid from the locking mechanism, and a device for assuring operations of the first driving mechanism and the second driving mechanism which are independent of the second driving mechanism and the first driving mechanism, respectively.

9 Claims, 9 Drawing Sheets

LID LOCK APPARATUS

BACKGROUND OF THE INVENTION

The present invention relates to a lid lock apparatus, and in particular to a lid lock apparatus for keeping the closed position of a lid used for opening/closing an opening of a vehicle body which is regarded as an inlet port of a fuel tank within the vehicle body.

In a conventional lid lock apparatus which is disclosed in German Patent Laid-open Print No. 3407125 published in Sep. 5, 1985, a locking mechanism for keeping the closed position of a lid used for opening/closing an opening of a vehicle body is operatively connected to a first mechanism and a second mechanism both of which are set to release the lid from the locking mechanism.

However, in the foregoing structure, the first mechanism is in association with the second mechanism in the mechanical linkage and vice versa, when the first (second) mechanism is initiated for releasing the lid from the locking mechanism, a force is inevitably applied to the second (first) mechanism, which leads in the long run to the malfunctioning of the second (first) mechanism.

SUMMARY OF THE INVENTION

It is an object of the invention to provide an improved lid lock apparatus which obviates the above conventional drawbacks.

It is another object of the invention to provide an improved lid lock apparatus which has two independent driving mechanisms so constituted that one of the driving mechanisms is not affected by the other upon operation thereof.

In order to attain the foregoing objects, a lid lock apparatus is comprised of a lid pivotally mounted to a vehicle-body for opening/closing an opening formed therein and movable between an open position and a closed position, a locking mechanism which is in engagement with the lid in order to hold the lid at its closed position, a first driving mechanism associated with the locking mechanism for releasing the lid from the locking mechanism for releasing the lid from the locking mechanism, and means for assuring operation of the first driving mechanism and the second driving mechanism which are independent of the second driving mechanism and the first driving mechanism, respectively.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENT

Figure 1:
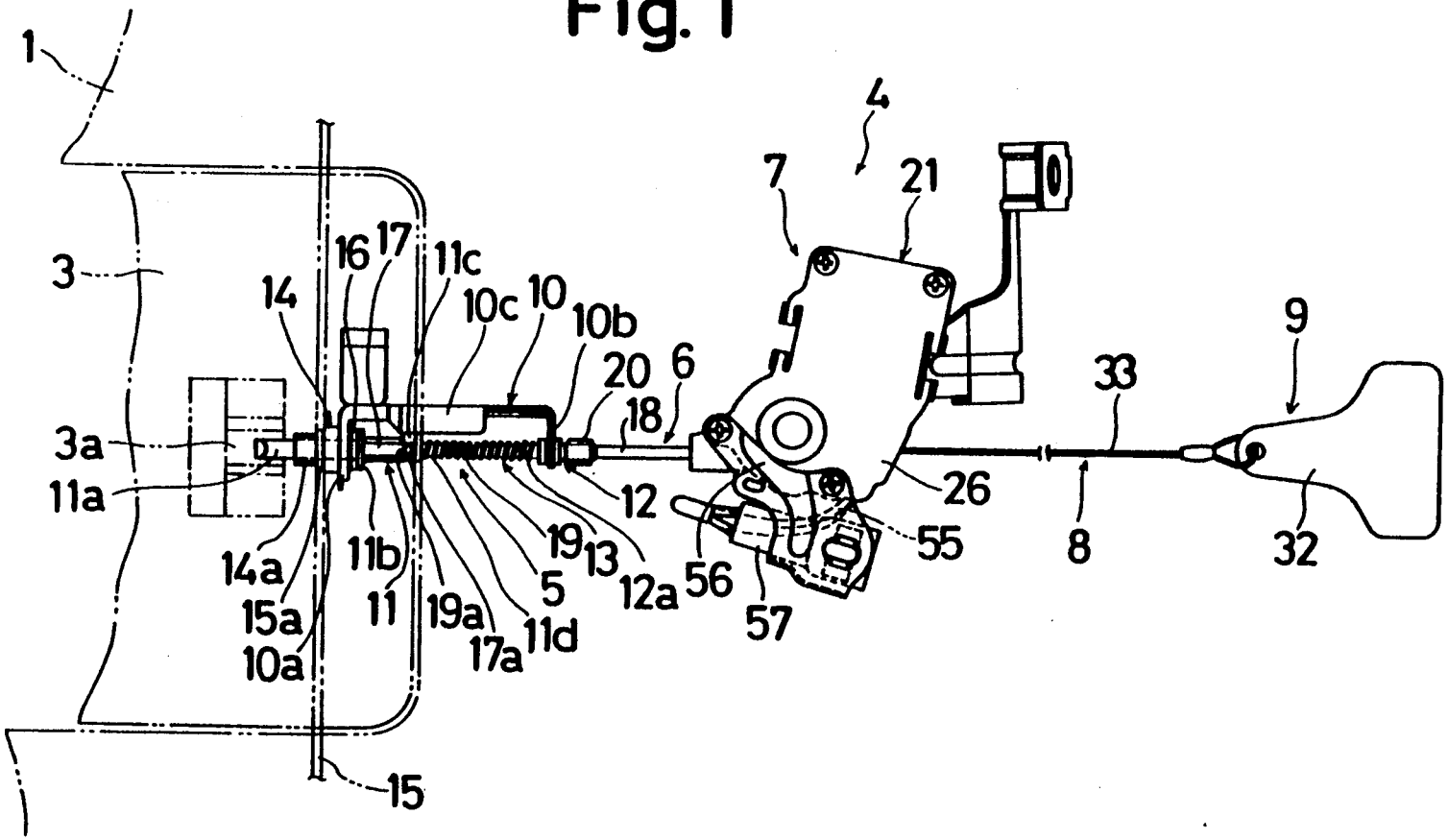
FIG. 1 is a plane view showing the mounted condition of a lid lock apparatus according to the present invention.
Figure 2:
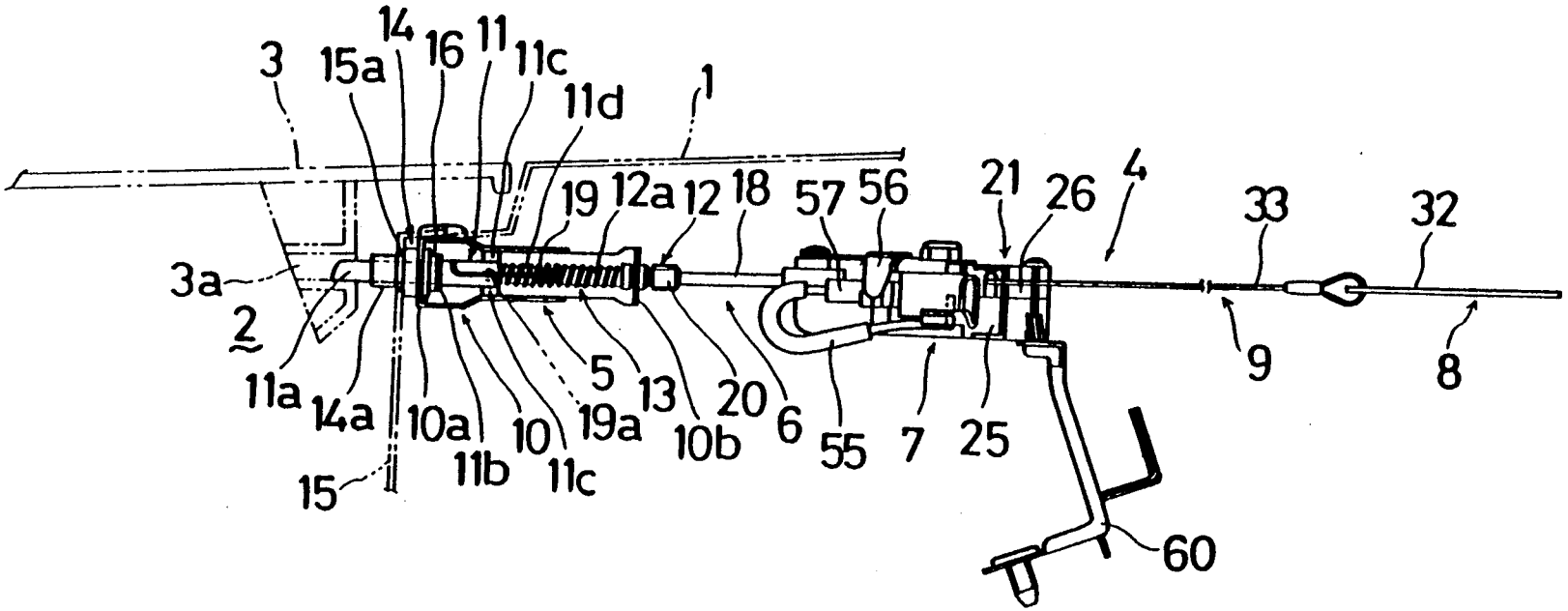
FIG. 2 is a side view showing the mounted condition of a lid lock apparatus according to the present invention.

Referring to FIGS. 1 and 2, a vehicle body 1 is formed with an opening 2 which is used as an inlet port of a fuel tank (not shown). A lid 3 for opening/closing the opening 2 is pivotally mounted to the vehicle body 1 in such a manner that an outer surface of the vehicle body 1 is in a common plane with an outer surface of the lid 3 in the closed position thereof. As will be detailed later, the closed position of the lid 3 is held by a lid lock apparatus 4.

The lid lock apparatus 4 includes a locking mechanism 5 for holding the lid 3 in its closed position, a first driving mechanism 6 for releasing the holding relationship between the locking mechanism 5 and the lid 3 in its closed position, a first linkage mechanism 7 for establishing the linkage relationship between the locking mechanism 5 and the first driving mechanism 6, a second driving mechanism 8 for releasing the holding relationship between the locking mechanism 5 and the lid 3 in its closed position, and a second linkage mechanism 9 for establishing the linkage relationship between the locking mechanism 5 and the second driving mechanism 8 via the first driving mechanism 6 and the first linkage mechanism 7.

Figure 3:
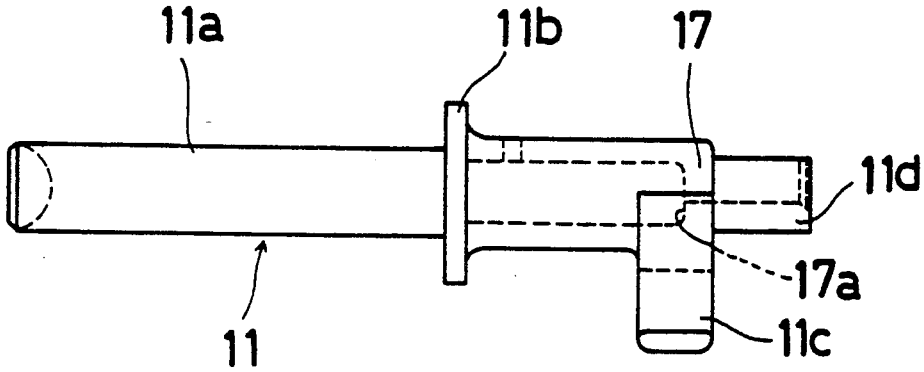
FIG. 3 is a plane view of a shaft.
Figure 4:
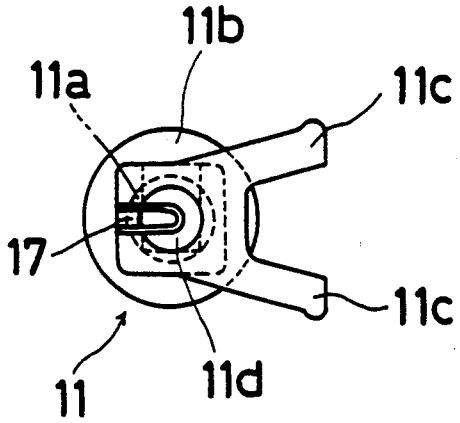
FIG. 4 is a side view of a shaft.

The locking mechanism 5 has a base 10, a shaft 11, a retainer **11*d*, and a spring 13. The base 10 which is originally a flat metal sheet is formed or bent into a configuration having at its opposite ends with a pair of opposed supporting portions 10*a* and 10*b*. The shaft 11 is comprised of, as best shown in FIGS. 3 and 4, an operating portion 11*a*, flange portion 11*b*, a foot portion 11*c* and a retain portion 11*d* which are formed integrally with each other. As shown in FIGS. 1 and 2, the operating portion 11*a* of the shaft 11 is slidably supported by a guide 14 which is secured to the supporting portion 10*a* of the base 10, and a distal end of the operating portion 11*a* of the shaft 11 is in engagement with a concave or recessed portion 3*a* in the lid 3 under the illustrated condition. The guide 14 has a screw portion 14*a*, which is inserted within a hole 15*a* of a panel 15, threadably mounted with a nut (not indicated) between the panel 15 and the supporting portion 10*a*. Thus, the shaft 11 is held by the panel 15 in such a manner that the shaft 11 is movable in the horizontal direction. Between the guide 14 and the flange 11*b* of the shaft 11, there is disposed a seal member 16 in order to prevent the invasion of water, vapour of gasoline and/or dust into an inner side of the vehicle body 1. The retainer 12 has a retaining portion 12*a* and between the retain portion 12*a* and the retaining portion 11*d* of the shaft 11 there is interposed a spring 13 in order to urge continually the shaft 11 in the direction of its extension which corresponds to the leftward direction in FIG. 1. Due to the opposed relationship between both retainers 11***a* and 12*a*, the retainer 12*a* serves as a stopper which regulates a retract movement of the shaft 11 in the rightward direction in FIG. 1. The foot portion 11*c* of the shaft 11 is in abutment with a wall 10*c* of the base 11 for the prevention of the rotation of the shaft 10 about its axis. In addition, as shown in FIGS. 3 and 4, the shaft 11 is provided at its rear side a cavity 17. The cavity 17 is opened in the rearward direction, extended in the horizontal direction and has a stopper wall 17*a*.

Figure 5:
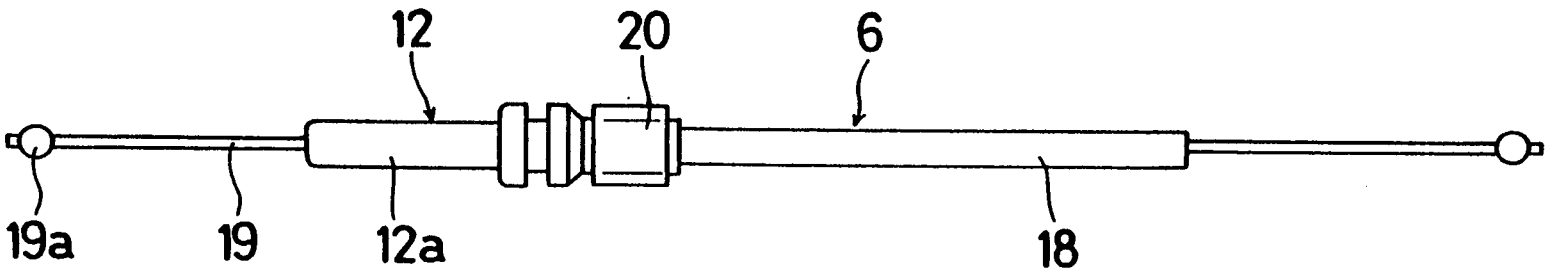
FIG. 5 is a plane view of a first linkage mechanism.

As shown in FIGS. 1, 2 and 5, the first linkage mechanism 6 is constituted by an outer tube 18 and an inner wire 19 which is accommodated slidably in the outer tube 18. A left end of the outer tube 18 is secured to the retainer 12 via a ring 20. A left end of the inner wire 19 is held at the stopper wall 17*a* of the shaft 11 which is in coincidence with the axis of the shaft 11 via a bracket 19*a* connected to a left end of the spring 13 after being passed through the retainer 12 and the spring 13. Thus, a portion at which the inner wire 19 is secured to the stopper wall 17*a*, the shaft 11 and the spring 12 are on a common axis, which results in that the application direction of the inner wire 19 to the shaft 11 is the same as the biasing direction of the spring 13. This will assure the smooth movement of the shaft 11 through the guide 14. The function for retaining the outer tube 18 and the function for regulating an excess movement of the shaft 11 in its retracting direction are established only by the retainer 12, which enables the reduction of the number of parts.

As shown in FIGS. 1 and 2, the second driving mechanism 8 is in the form of a handle 32 which is located within a trunk or a passenger room of in the vehicle body 1 and is connected with a wire 33 which is regarded as the second linkage mechanism 9.

Figure 6:
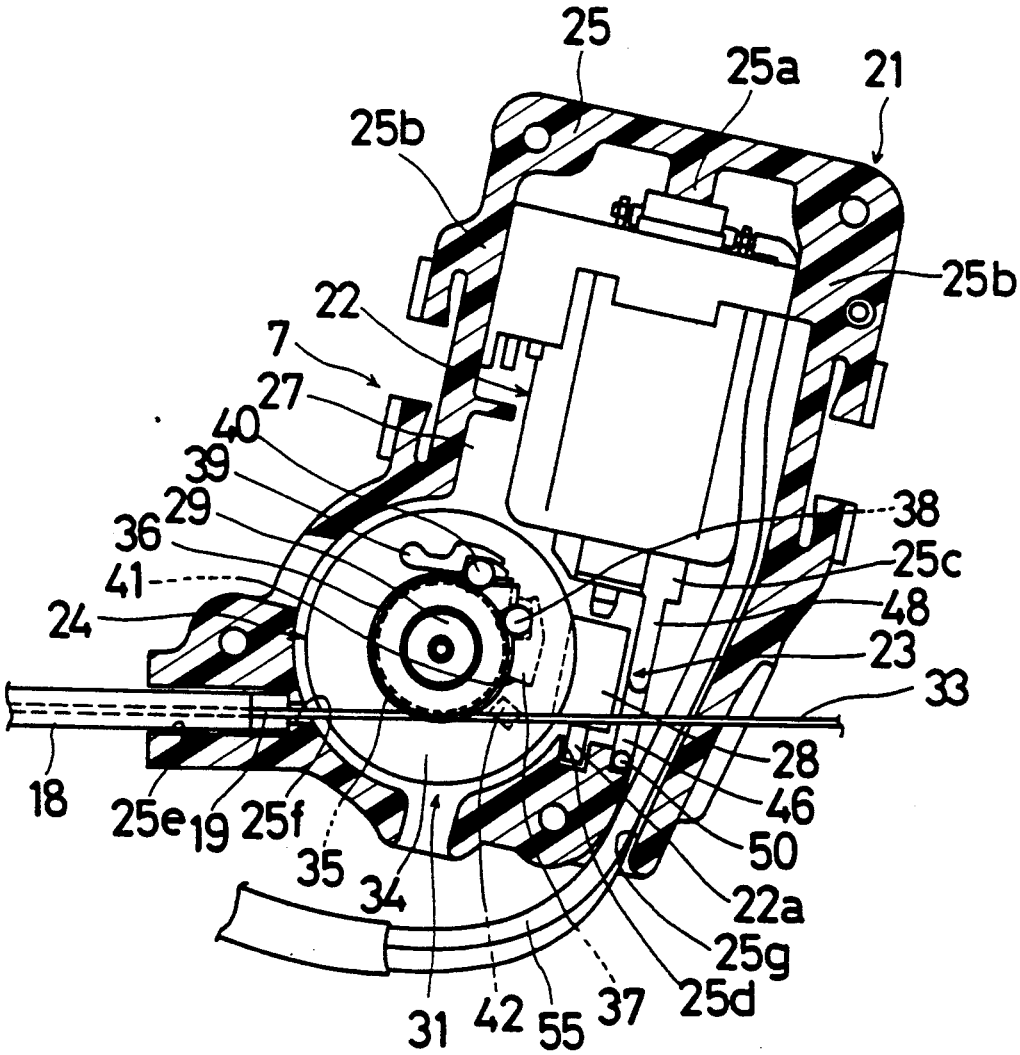
FIG. 6 is a vertical cross-sectional view of a first driving mechanism.
Figure 7:
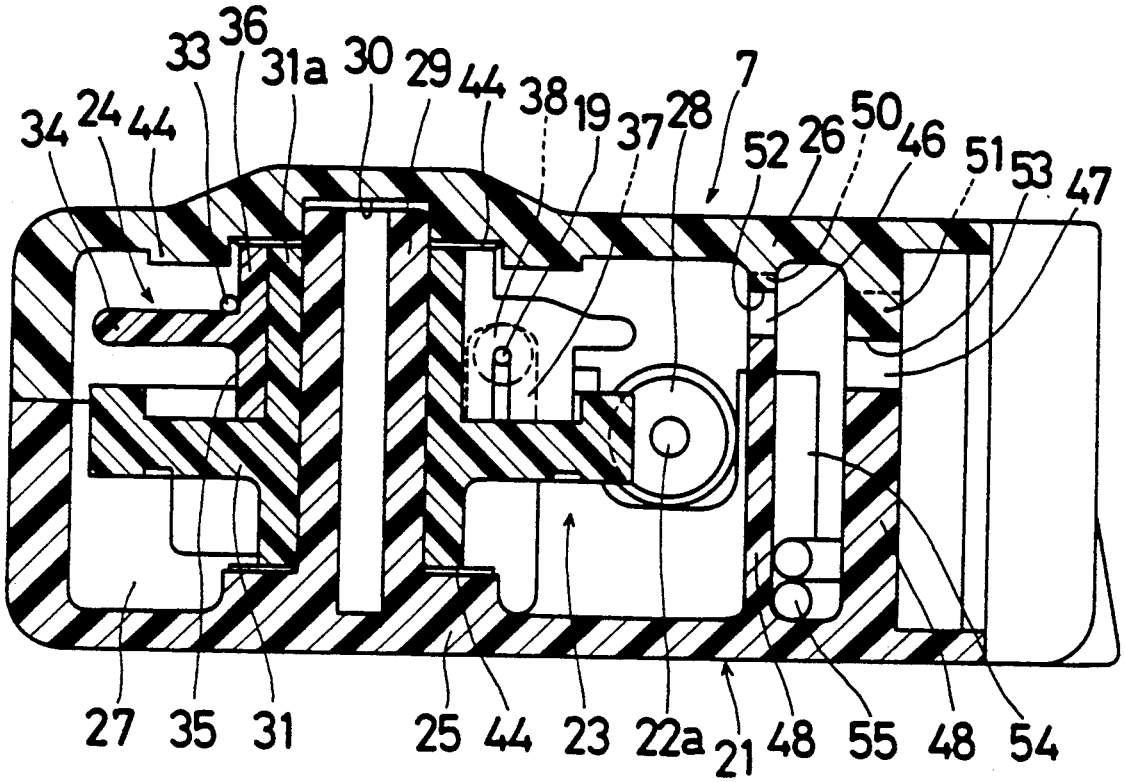
FIG. 7 is a horizontal cross-sectional view for showing how a spring is located at a position.
Figure 8:
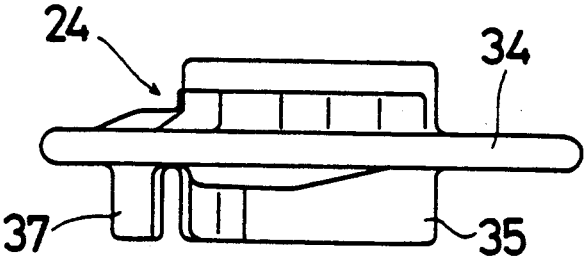
FIG. 8 is a front view of a drum.
Figure 9:
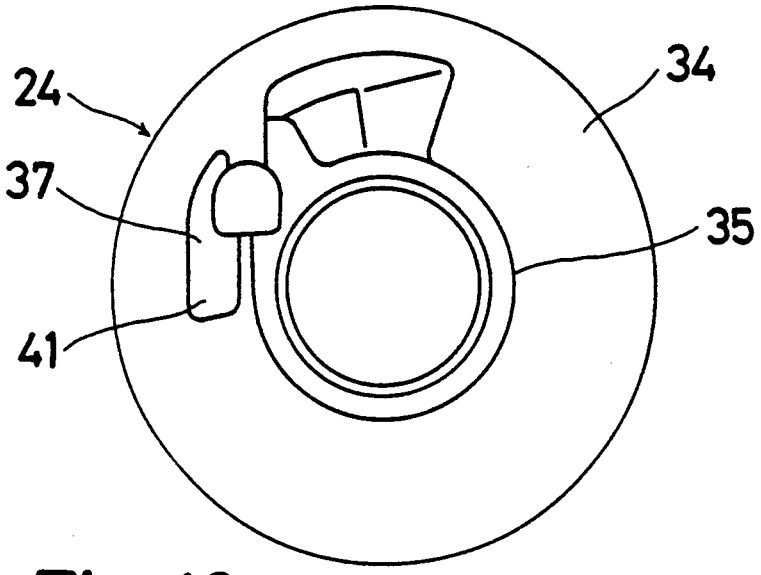
FIG. 9 is a lower side plane view of a drum.
Figure 10:
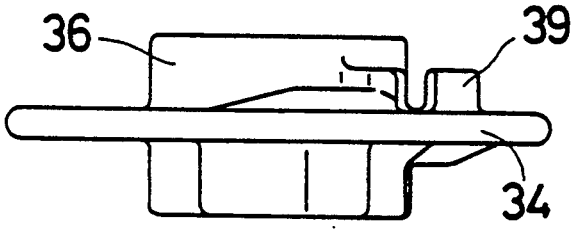
FIG. 10 is a rear side plane view of a drum.
Figure 11:
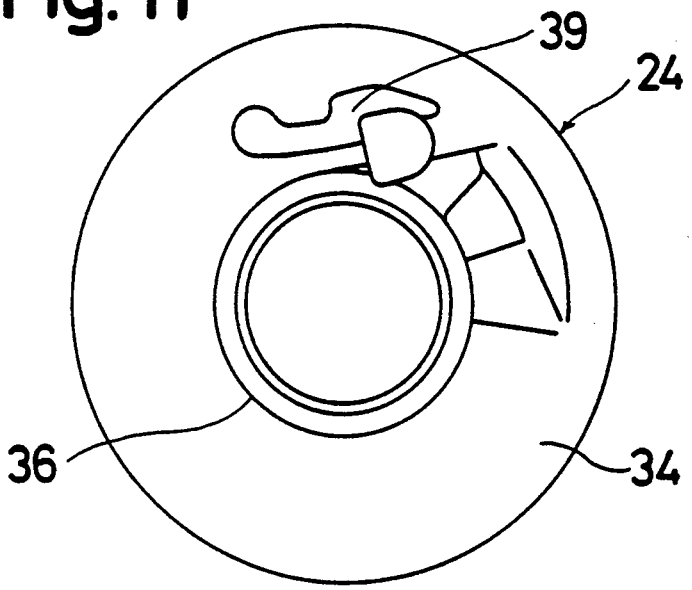
FIG. 11 is an upper side plane view of a drum.

As shown in FIGS. 6 and 7, the first driving mechanism 7 includes a casing 21, a motor 22, a gear mechanism 23, and a drum 24. The casing 21 is of a coupling configuration of a housing 25 and a cover 26, and has an inner space 27 in which the motor 22, the gear mechanism 23, and the drum 24.

The motor 22 is held by holding portions 25*a*, 25*b* and 25*c* formed at the housing 25 and has a shaft 22*a* which is rotatably supported by a bearing portion 25*d* of the housing 25. The shaft 22*a* of the motor 22 is secured with a worm gear 28 so as to establish a unitary rotation therewith. A gear shaft 29 is fixedly connected to the housing 25 and is rotatably mounted to a worm wheel 31 which is in mesh engagement with the worm gear 28. This mesh engagement is so established as to enable the torque transmission from one to the other and vice versa by selecting a suitable advancing angles of each tooth of the worm wheel 31 and the worm gear 28.

A distal end of the gear shaft 29 is received in a recess portion 30, thereby enabling the bearing of the load from the worm gear 31 to the gear shaft 29 by both of the housing 25 and the cover 26. Around a shaft portion 31*a* of the worm wheel 31, the drum 24 is rotatably mounted. As shown in FIGS. 8 through 12, an outer periphery of the drum 24 is divided by a separator 34 into a first portion 35 and a second portion 36 in its axial direction which corresponds to the vertical direction in FIG. 7. A right end of the inner wire 19 which is connected with a retainer 38 is passed through a hole 25*f* of the housing 25 and is terminated within the inner space of the housing 27 so as to establish the engagement between the retainers 37 and 38.

A right end of the outer tube 18 is snugly fitted in a hole 25*e* in the housing 25. A retainer 39 at the second portion 36 of the drum 24 is set to be in engagement with a retainer 40 which is secured to the right end of the wire 33 which is wound around the second portion 36 after being passed through a hole 46 and a hole 47 of the housing 25.

Figure 12:
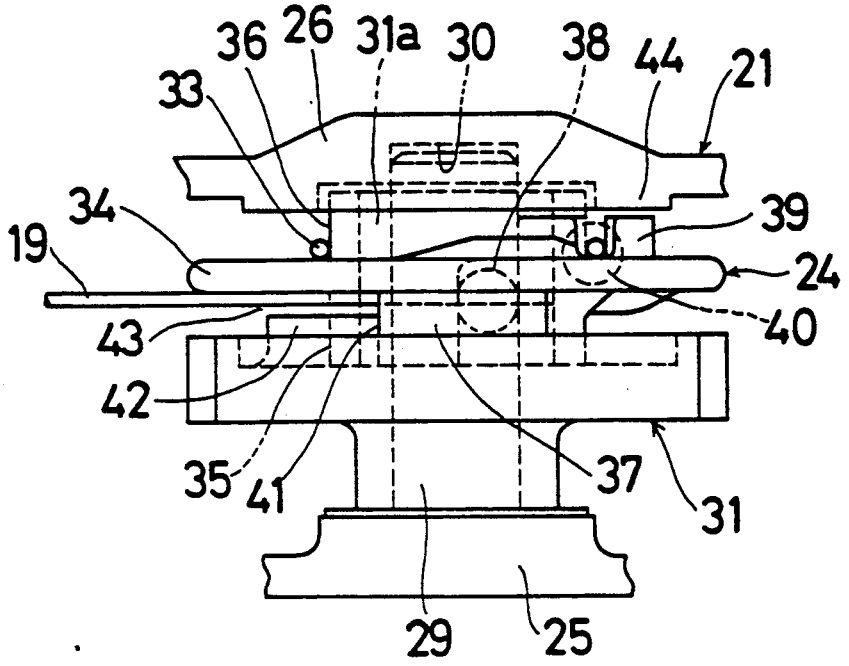
FIG. 12 is an enlarged view for showing the relationship between a drum and a worm wheel.
Figure 13:
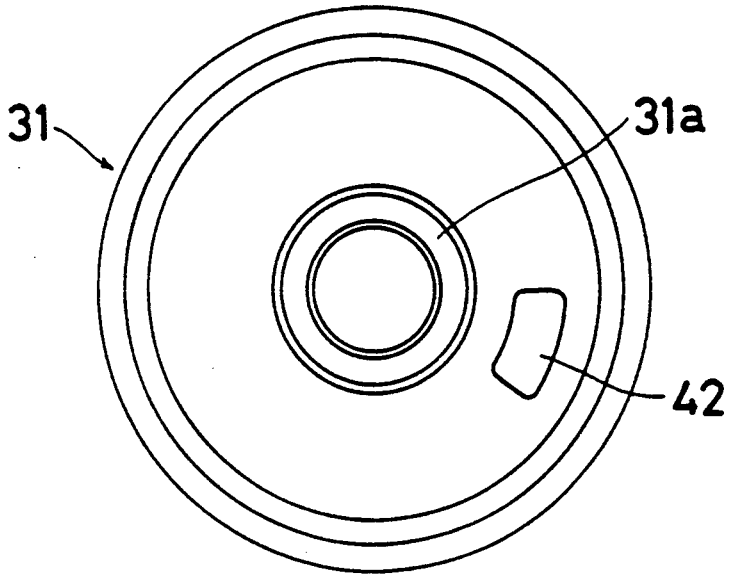
FIG. 13 is a plane view of a worm wheel.
Figure 14:
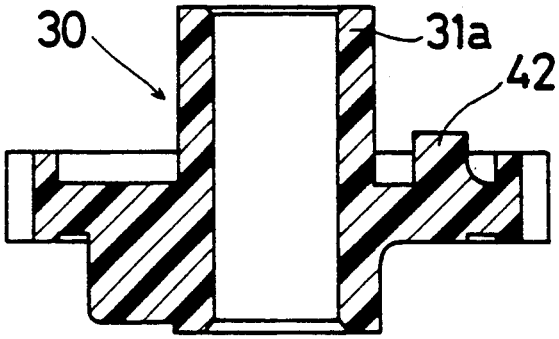
FIG. 14 is a vertical cross-sectional view of a worm wheel.

The drum 24 is provided with an abutting portion 41 which is formed integrally with the retainer 37, and the worm wheel 31 is, as shown in FIGS. 12 through 14, provided with a transmitting portion 42 which is set to be engaged with the retainer 37 only when the worm wheel 31 is rotated in one direction. It is to be noted that a gap has a radius larger than that of the inner wire 19 in order that the inner wire 19 is prevented from being held between the transmitting portion 42 and the separator 34. In addition, a washer 44 is interposed between the housing 25 and one axial end of the worm wheel 31 (between the cover 26 and the co-axial arrangement of the other axial end of the worm wheel 31 and the axial end of the drum 24) and each washer 44 is set to receive the reaction force of the load to be applied to the worm wheel 31 during operation of this device in order to prevent the increasing the operational friction or resistance between the housing 25 and one axial end of the worm wheel 31 (between the cover 26 and the co-axial arrangement of the other axial end of the worm wheel 31 and the axial end of the drum 24). Furthermore, above the drum 24, an annular projection 45 extends from the cover 26 which is so directed to the drum 24 as to be closer to the drum 24 as compared to the washer 44 in order to prevent the entrance of the wire 33 between the drum 24 and the cover 26.

Figure 15:
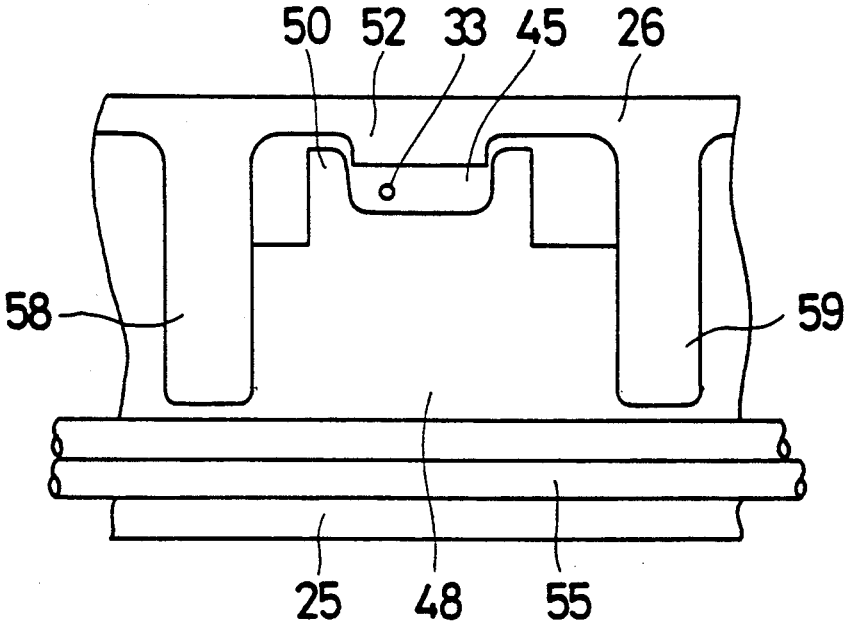
FIG. 15 is a partially cross-sectional view of a wire under its retained condition.

As shown in FIGS. 7 and 15, the housing 25 has a pair of upstanding walls 48 and 49; and each distal end thereof is formed with a recess portion 50/51. The cover 26 is provided with a pair of projecting portions 52 and 53 which are set to be received in the recess portions 50 and 51, respectively, resulting in hole 46 being defined between the portions 50 and 52 (a hole 47 is defined between the portions 51 and 53) through which the wire 33 can be passed.

As shown in FIGS. 6, 7 and 15, a path 54 is defined between the walls 48 and 49 through which lead wire 55 connected to the motor 22 are passed. The lead wires 55 is extended outside of the housing 25 through the hole 25*g* and is connected to a connector 57 (shown in FIGS. 1 and 2) which is fixedly connected to the cover 26 via a bracket 56. In order to prevent the interference between the wire 33 and the lead wires 55, a pair of walls 58 and 59 are formed in the cover 26 which are set to extend toward the passage 54 for holding lead wires 55 at a bottom of the passage 54.

It is to be noted that the case 21 is secured to the panel 15 via the bracket 60.

Hereinafter, an operation of the foregoing lid lock apparatus will be described. Under the condition shown in FIGS. 1 and 2 wherein the opening 2 is closed, the shaft 11 is urged by the spring 13 by which the operating portion 11*a* of the shaft 11 is received in the recess portion 3*a* of the lid 3, resulting in the lid 3 being in its locked position. When the motor 22 is turned on, the resultant rotation is transmitted via the worm gear 28 to the worm wheel 31, thereby establishing a rotation thereof in one direction. This rotation causes the abutting portion 41 to engage the transmitting member 42, and the drum 24 is brought into rotation together with the worm wheel 31. Due to the resultant rotation of the drum 24, the inner wire 19, is wound around the first portion 35 of the drum 24, which causes the pulling of the inner wire 19. Then, the retainer portion 19*a* is brought into engagement with the stopper wall 17*a*, resulting in the shaft 11 being moved against the urging force of the spring 13 away from the recess portion 3*a* of the lid 3. Thus, the shaft 11 is extracted entirely and disengages the lid 3, thereby establishing the released or unlocked condition of the lid 3. During this process, the application direction of the force from the inner wire 19 to the shaft 11 and the urging direction of the spring 13 are the same, which enables a smooth operation. This means that the required output torque of the motor 22 is large, which leads to the minituarization thereof.

Thereafter, if the motor 22 is turned off, the shaft 11 returns to its original position as a result of the urging force of the spring 13, and then each of the worm wheel 31 and the worm gear 28 is also returned to its original position after being rotated in the other direction as a result of the return movement of the shaft 11 and the urging force of the spring 13. Under the resultant condition, if the lid 3 is desired to be transferred from its unlocked condition to locked condition, the operator is requested to urge the lid 3 toward the opening 2 only so that the operating portion 3*a* of the shaft 11 may be received in the recess portion 3*a* of the lid 3. Though the shaft 11 has to be moved temporarily in the unlocked direction before establishing receipt of the operating portion 11*a* of the shaft 11 into the recess portion 3*a* of the lid 3 during the foregoing return movement thereof, the retainer 19*a* of the inner wire 19 is set to slide within the cavity 17 of the shaft 11. Thus, the inner wire 19 cannot be compressed due to the temporary retraction of the shaft 11, resulting in improvement of the durability of the inner wire 19. In addition, under the locked condition of the lid 3, if the handle 32 is manipulated, the drum 24 is rotated in one direction by winding the wire 33 around the second portion 36 of the drum 24. Despite of this, the relative position of the retainer portion 41 to the transmitting portion 42 assures the interruption of the transmission of the rotation of the drum 24 to the worm wheel 31. Thus, the handle 32 can be manipulated with less force due to the fact that the handle 32 is out of operative engagement with the worm wheel 31, the worm gear 28 and the motor 22. The rotation of the drum 24 in one direction brings the winding of the inner wire 19 around the first portion 35 of the drum 24, resulting in the shaft 11 being moved away from the recess portion 3*a* of the lid 3 against the urging force of the spring 13 which leads to the establishment of the unlocked condition of the lid 3.

As mentioned above, the operation of the locking mechanism 5 is set to be established by the winding of the first linkage mechanism 6 as a result of the first driving mechanism 7, which enables the installation of the locking mechanism 5 to be separate from the first driving mechanism 7. Thus, this device can be installed in any vehicle body due to the fact that the locking mechanism 5 and the first driving mechanism 7 can be arranged flexibly depending on the space condition within the vehicle body.

In the case of the retracting movement of the shaft 11 for establishing the unlocked condition of the lid 3 which is performed by the manipulation of the handle 32, ultimately the wire 19 is set to be wound around the drum 24, which in turn is rotated by the wire 33.

Obviously, numerous modifications and variations of the present invention are possible in light of the above teachings. It is therefore to be understood that within the scope of the appended claims, the invention may be practiced otherwise than as specifically described therein.

What is claimed is:

1. A lid lock apparatus, comprising:

a lid pivotally mounted to a vehicle body for opening and closing an opening formed in the vehicle body, said lid being movable between an open position and a closed position;

a locking mechanism engagable with the lid for holding the lid in the closed position;

a drum mounted to rotate about an axis;

a wire connected to the locking mechanism and wound around the drum, the wire being pulled in a direction away from the locking mechanism upon rotation of the drum in one direction;

a first driving mechanism for rotating the drum in the one direction;

a second driving mechanism for rotating the drum in the one direction; and a clutch device coupled to the drum, said clutch device being brought into an engaged condition in response to the rotation of the drum by the first driving mechanism, said clutch device remaining in a released condition upon rotation of the drum by the second driving mechanism.

2. A lid lock apparatus according to claim 1, wherein the clutch device includes a pair of angularly spaced projections provided to the drum and the first driving mechanism, respectively.

3. A lid lock apparatus according to claim 1, wherein the first driving mechanism includes a motor with a shaft, a worm gear secured thereto and a worm wheel which is in mesh engagement with the worm gear.

4. A lid lock apparatus according to claim 1, wherein the second driving mechanism is in the form of a second wire wound around the drum.

5. The lid lock apparatus of claim 1, wherein the drum includes a first portion and a second portion, the first portion being axially positioned relative to the second portion, wherein the wire is wound around the first portion of the drum, and wherein the clutch device includes a pair of angularly spaced projections on the drum and the first driving mechanism.

6. The lid lock apparatus of claim 1 wherein the drum includes a first portion and a second portion, the first portion being axially positioned relative to the second portion, and wherein the wire is wound around the first portion of the drum, and the first driving mechanism includes a motor with a shaft; a worm gear secured to the shaft, and a worm wheel in mesh engagement with the worm gear.

7. The lid lock apparatus of claim 1 wherein the drum includes a first portion and a second portion, the first portion being axially positioned relative to the second portion, the wire being a first wire wound around the first portion, and wherein the second driving mechanism is a second wire wound around the second portion of the drum.

8. The lid lock apparatus of claim 7, wherein the first driving mechanism includes a motor with a shaft, a worm gear secured to the shaft, and a worm wheel in mesh engagement with the shaft.

9. The lid lock apparatus of claim 8, wherein the worm wheel is positioned coaxially with the drum.

* * * * *